US011079104B2

(12) United States Patent
Wu

(10) Patent No.: US 11,079,104 B2
(45) Date of Patent: Aug. 3, 2021

(54) FLAME-RESISTANT WICK

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 112 days.

(21) Appl. No.: 16/515,146

(22) Filed: Jul. 18, 2019

(65) Prior Publication Data

US 2020/0400307 A1 Dec. 24, 2020

(30) Foreign Application Priority Data

Jun. 21, 2019 (TW) ..... 108121643

(51) Int. Cl.
*F23D 3/00* (2006.01)
*F23D 3/08* (2006.01)
*F23D 3/40* (2006.01)

(52) U.S. Cl.
CPC ..... *F23D 3/08* (2013.01); *F23D 3/40* (2013.01); *F23D 2900/03082* (2013.01)

(58) Field of Classification Search
CPC .... F23D 3/08; F23D 3/40; F23D 2900/03082; F23D 3/18; F23D 3/24; F23D 2212/201; F21V 37/002
See application file for complete search history.

(56) References Cited

U.S. PATENT DOCUMENTS

| | | | | |
|---|---|---|---|---|
| 2,210,290 | A | 8/1940 | Heinsohn | |
| 2,504,584 | A | 4/1950 | Ramos | |
| 2,829,511 | A | 4/1958 | Oesterle et al. | |
| 3,083,952 | A * | 4/1963 | Goodloe | B01J 19/32 428/592 |
| 3,627,191 | A * | 12/1971 | Hood, Jr. | B23K 3/08 228/19 |
| 4,569,656 | A | 2/1986 | Shimizu et al. | |
| 5,305,941 | A * | 4/1994 | Kent | B23K 3/08 228/19 |
| 6,270,340 | B1 * | 8/2001 | Lepp | F23D 3/08 431/288 |
| 7,140,421 | B2 | 11/2006 | Hsu | |
| 9,109,797 | B2 | 8/2015 | Chen | |
| 9,885,474 | B2 | 2/2018 | Chen | |
| 10,690,338 | B2 | 6/2020 | Chen | |
| 2004/0037039 | A1 * | 2/2004 | Shimura | H01L 23/427 361/700 |
| 2008/0283222 | A1 | 11/2008 | Chang et al. | |

(Continued)

FOREIGN PATENT DOCUMENTS

| | | | |
|---|---|---|---|
| CN | 1067303 | A | 12/1992 |
| CN | 206944144 | U | 1/2018 |

(Continued)

*Primary Examiner* — Alfred Basichas
(74) *Attorney, Agent, or Firm* — Alan D. Kamrath; Karin L. Williams; Mayer & Williams PC

(57) ABSTRACT

A flame-resistant wick includes a hollow chamber and at least one capillary structure surrounding the hollow chamber. The at least one capillary structure is interlaced by a plurality of wire strands into a tubular shape. Each of the plurality of wire strands consists of a plurality of core wires made of a material having a melting point of not less than 800° C.

11 Claims, 9 Drawing Sheets

(56) References Cited

U.S. PATENT DOCUMENTS

| | | | | |
|---|---|---|---|---|
| 2009/0011270 | A1 | 1/2009 | Hsu | |
| 2014/0087318 | A1* | 3/2014 | Chen | F23D 3/18 431/320 |

FOREIGN PATENT DOCUMENTS

| | | | |
|---|---|---|---|
| GB | 708412 | A | 5/1954 |
| GB | 2080514 | A | 2/1982 |
| JP | S59153404 | U | 10/1984 |
| JP | S60108607 | A | 6/1985 |
| JP | 2002228117 | A | 8/2002 |
| KR | 1019990086012 | A | 12/1999 |
| TW | 253525 | | 8/1995 |
| TW | 493722 | U | 7/2002 |
| TW | 580106 | U | 3/2004 |
| WO | WO2008129264 | A1 | 10/2008 |

* cited by examiner

FLAME-RESISTANT WICK

BACKGROUND

The present invention relates to a wick and, more particular, to a flame-resistant wick that possesses an excellent heat resistant property.

A conventional lamp device includes a fuel cup storing fuel, a high temperature resistant disk mounted on the fuel cup, and a wick inserted through the disk to connect with fuel stored in the fuel cup. Moreover, the wick is normally made out of braided cotton and works by capillary action. Fuel is drawn up through the wick to reach the flame produced on the disk. The above lamp device is actively used for various purposes, such as lighting, decorating, or increasing atmosphere. For example, an oil lamp is used in religion, or an alcohol lamp is used in medical or chemical laboratories.

The conventional cotton wick must be cut to a predetermined length adapted to be mounted to the lamp device. However, after trimming, the cotton wick is easily loosened at its terminal end to cause it to be difficult to insert through the disk. After ignition, fuel vaporizes and combusts on the wick, and the tip of the cotton wick will be carbonized and burnt out gradually on the tip due to a higher temperature on the top of flame. Thus, the cotton wick must be pulled out from the disk and trimmed to a certain length every once in a while to maintain a combustion scale. Trimming the cotton wick results in the wick eventually being unconnected with fuel, so that users must replenish the fuel or replace a new wick. It is inconvenient and wasteful.

The wick length, diameter, stiffness and flame resistance are the major factors used to adjust fuel wicking and flame scale for the lamp device. However, cotton wicks with low stiffness and flame resistance cannot be adjusted easily to maintain proper fuel wicking and flame scale. High viscosity or high flash point fuels result in carbon deposits being produced and are difficult to ignite. If the fuel drawn is slower than it burns, the wick will be carbonized and burnt out. If the fuel is drawn faster than it burns, usually occurring with burning high flash point fuel, slow evaporation of the fuel will be caused, producing soot due to incomplete combustion. Incomplete combustion not only produces soot but also toxic fumes.

Taiwan Patent No. 493,722 discloses a wick including a plurality of fiberglass filaments disposed and assembled at a center thereof to form a fiberglass layer, and a plurality of fiberglass yarns and melted silks arranged around the fiberglass layer. The fiberglass layer is able to draw fuel by capillary action, is hard to burn down, and is not easily loosened at its terminal end. However, the fiberglass layer does not draw fuel effectively, causing the flame to extinguish easily, and the flame scale is difficult to control. Moreover, Taiwan Patent No. 580,106 discloses a wick including a cotton thread, enabling fuel to be drawn and a plurality of fiberglass filaments covering around the cotton thread to avoid the cotton thread from being loosened to provide a compound wick.

Therefore, the wick disclosed by said patents both include fiberglass filaments, but the fiberglass is expensive and difficult to process. The wick is a large quantity of consumable items, but the fiberglass wick is expensive and not environment-friendly. Additionally, when the fiberglass wick is processed, inhaling the fiberglass can cause damage to human lungs and can be harmful to manufacturing personnel. Inhaling of fiberglass will jeopardize the health of workers during fiberglass-reinforced plastic processing. The fiberglass fiber can also cause skin, eye and throat irritation to users. At higher exposure levels, fiberglass also has been associated with skin rashes and difficulty in breathing.

Further, the melting point of the fiberglass wick is only about 680° C., so the fiberglass wick will be carbonized and burned out under the flame burning at 1000° C., but only slower than the cotton wick. Therefore, the fiberglass wick also needs be trimmed.

Furthermore, the fiberglass wick and the cotton wick are easy to sag, due to gravity, when they are saturated with fuel. Thus, the user cannot easily adjust the flame height or scale. If a user wants to adjust the flame height or scale, the user has to pull the wick out from the lamp device constantly. At the same time, the user may also contact fuel in the wick and cause inconvenience or even danger.

Thus, a need exists for a novel wick to mitigate and/or obviate the above disadvantages.

SUMMARY

A flame-resistant wick according to the present invention includes a hollow chamber and at least one capillary structure surrounding the hollow chamber. The at least one capillary structure is interlaced by a plurality of wire strands into a tubular shape. Each of the plurality of wire strands consists of a plurality of core wires being made of a material having a melting point of not less than 800° C.

In an example, at least one of the plurality of core wires is made of metals whose melting point of not less than 800° C. or carbon fiber material.

In an example, the metals include copper or stainless steel.

In an example, the at least one of the plurality of core wires is made of copper, and the others of the plurality of core wires are made of non-copper materials.

In an example, at least one of the others of the plurality of core wires is made of carbon fiber material.

In an example, the number of the plurality of core wires made of copper is not greater than the number of the plurality of core wires made of non-copper materials in each of the plurality of wire strands.

In an example, each of the plurality of core wires has a different wire diameter to the others.

In an example, the at least one capillary structure is flexible.

In an example, the at least one capillary structure is capable of being bent into a U shape to form an igniting end and two drawing ends located opposite to the igniting end.

In an example, the plurality of wire strands includes a plurality of first wire strands and a plurality of second wire strands interlaced with one another. Each of the plurality of first wire strands interlaces with at least one of the plurality of second wire strands to form an acute angle.

In an example, the plurality of first wire strands and the plurality of second wire strands interlace with one another to form a plurality of meshes. Each of the plurality of meshes has the acute angle.

In an example, the at least one capillary structure includes two capillary structures, which are mounted around one another and extend along a central axis of the hollow chamber.

The present invention will become clearer in light of the following detailed description of illustrative embodiments of this invention described in connection with the drawings.

DETAILED DESCRIPTION

Figure 1:
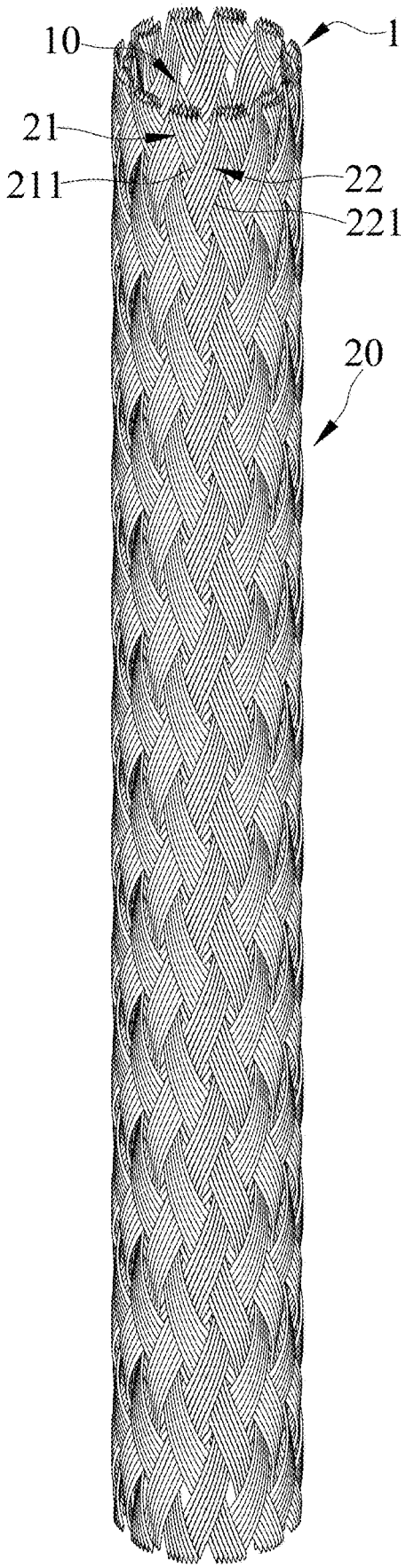
FIG. 1 is a perspective view of a flame-resistant wick of a first embodiment according to the present invention.
Figure 2:
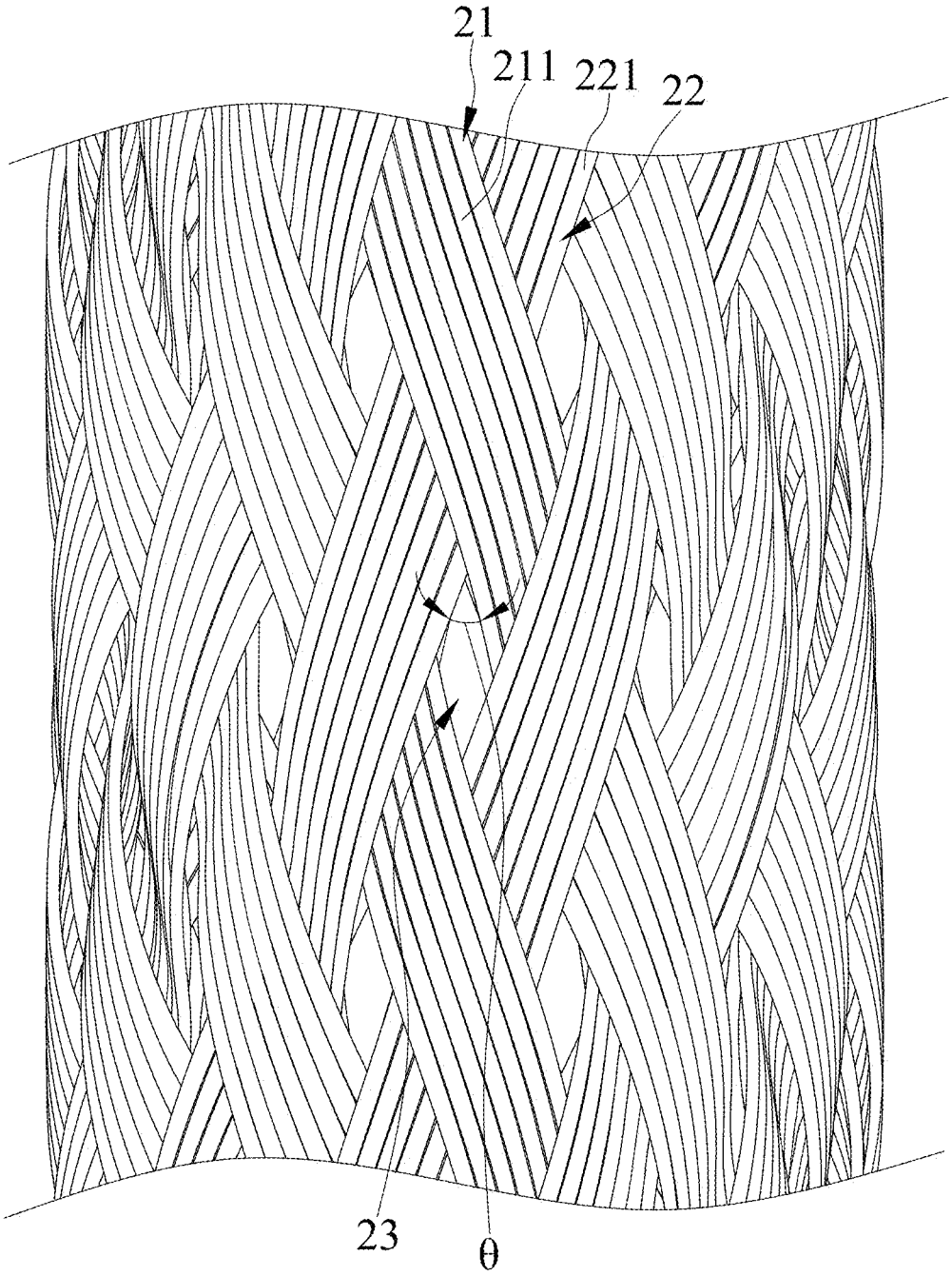
FIG. 2 is an enlarged partial perspective view of FIG. 1.

FIGS. 1-4 show a flame-resistant wick 1 of a first embodiment according to the present invention. The flame-resistant wick 1 includes a hollow chamber 10 and at least one capillary structure 20.

In the embodiment, the flame-resistant wick 1 may include one capillary structure 20 surrounding the hollow chamber 10 and interlaced by a plurality of wire strands into a tubular shape to cause the capillary structure 20 to be flexible.

The plurality of wire strands includes a plurality of first wire strands 21 and a plurality of second wire strands 22 interlaced with one another. Each of the plurality of first wire strands 21 interlaces with at least one of the plurality of second wire strands 22 to form an acute angle θ. Thus, the plurality of first wire strands 21 and the plurality of second wire strands 22 interlace with one another to form a plurality of meshes 23, and each of the plurality of meshes 23 has the acute angle θ. Further, each of the plurality of first wire strands 21 consists of a plurality of first core wires 211, and each of the plurality of second wire strands 22 consists of a plurality of second core wires 221. Furthermore, the plurality of first and second core wires 211 and 221 are made of a material having a melting point of not less than 800° C. to provide flame-resistant purpose.

Moreover, the plurality of first and second core wires 211 and 221 can be made of metals whose melting point is not less than 800° C. or carbon fiber material and have the same wire diameter. The metals may include copper or stainless steel. The melting point of copper is about 1085° C., the melting point of stainless steel is about 1400° C., and the melting point of carbon fiber material is about 1500° C., all of which are materials with a melting point of not less than 800° C., and minimize carbonization and dissipation to achieve a flame-resistant effect under the flame burning of 1000° C. In addition, according to the flame reaction, the color of the ignited flame can be adjusted by changing the material of the plurality of first and second core wires 211 and 221, for example, one of the plurality of first and second core wires 211 and 221 is made of copper, so that a green flame can be obtained after ignition.

Figure 3:
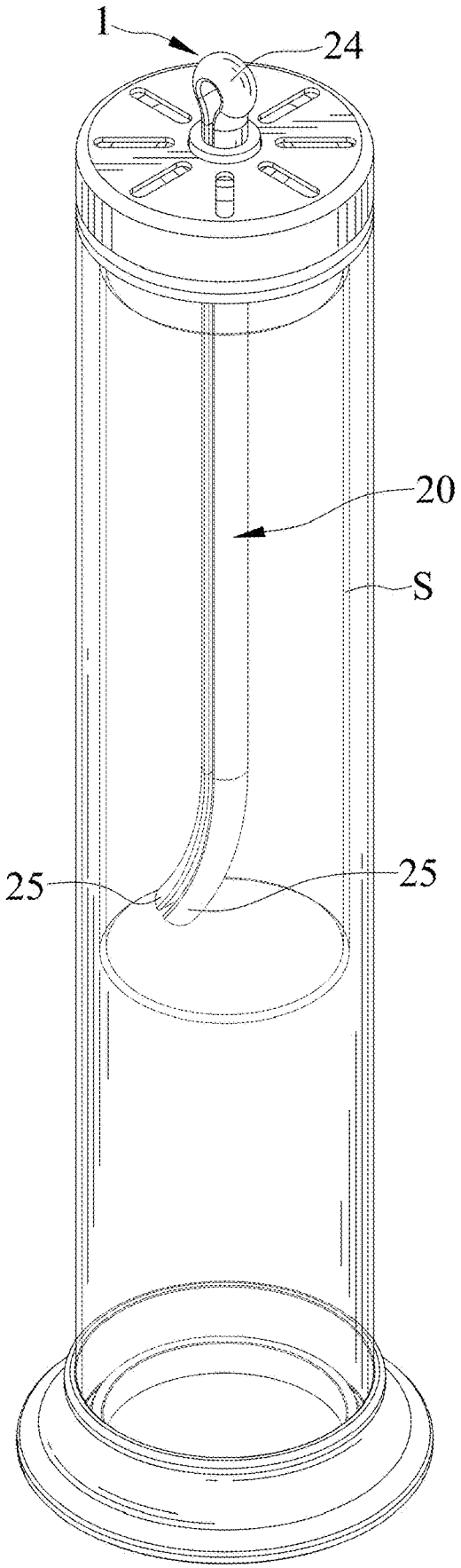
FIG. 3 is a schematic view showing the flame-resistant wick of FIG. 1 to be bended and inserted into a fuel container.
Figure 4:
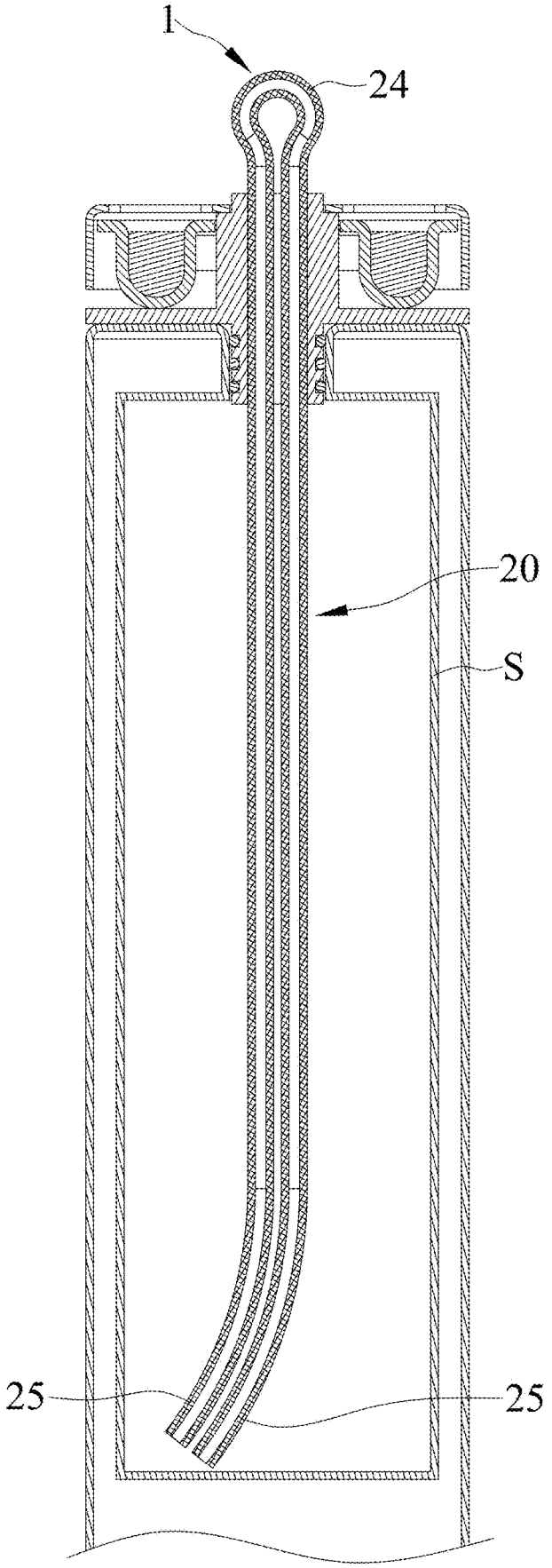
FIG. 4 is a cross-section view of FIG. 3.

FIGS. 3 and 4 show the capillary structure 20 to be bent into a U shape to form an igniting end 24 and two drawing ends 25 located opposite to the igniting end 24 before the flame-resistant wick 1 is inserted into a fuel container S. Therefore, the flame-resistant wick 1 can be used for various fuel containers S with different heights without cutting.

Figure 5:
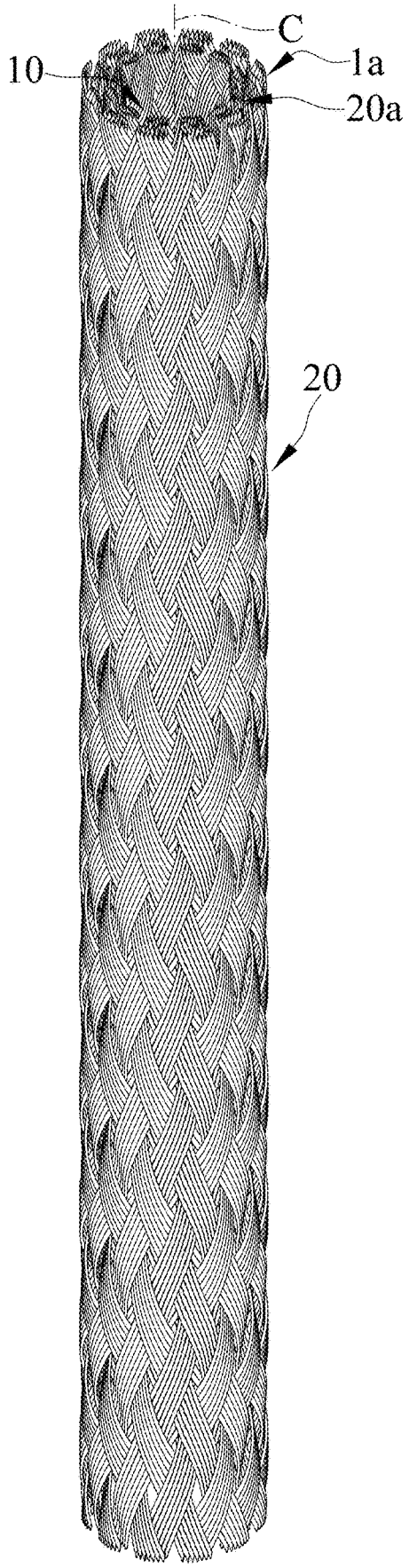
FIG. 5 is a perspective view of a flame-resistant wick of a second embodiment according to the present invention.

FIG. 5 show a flame-resistant wick 1*a* of a second embodiment according to the present invention, and the same numbers are used to correlate similar components of the first embodiment, but bearing a letter a. The second embodiment includes two capillary structures 20 and 20*a*, which are mounted around one another and extend along a central axis C of the hollow chamber 10 to maintain the shape after bending easily.

Figure 6:
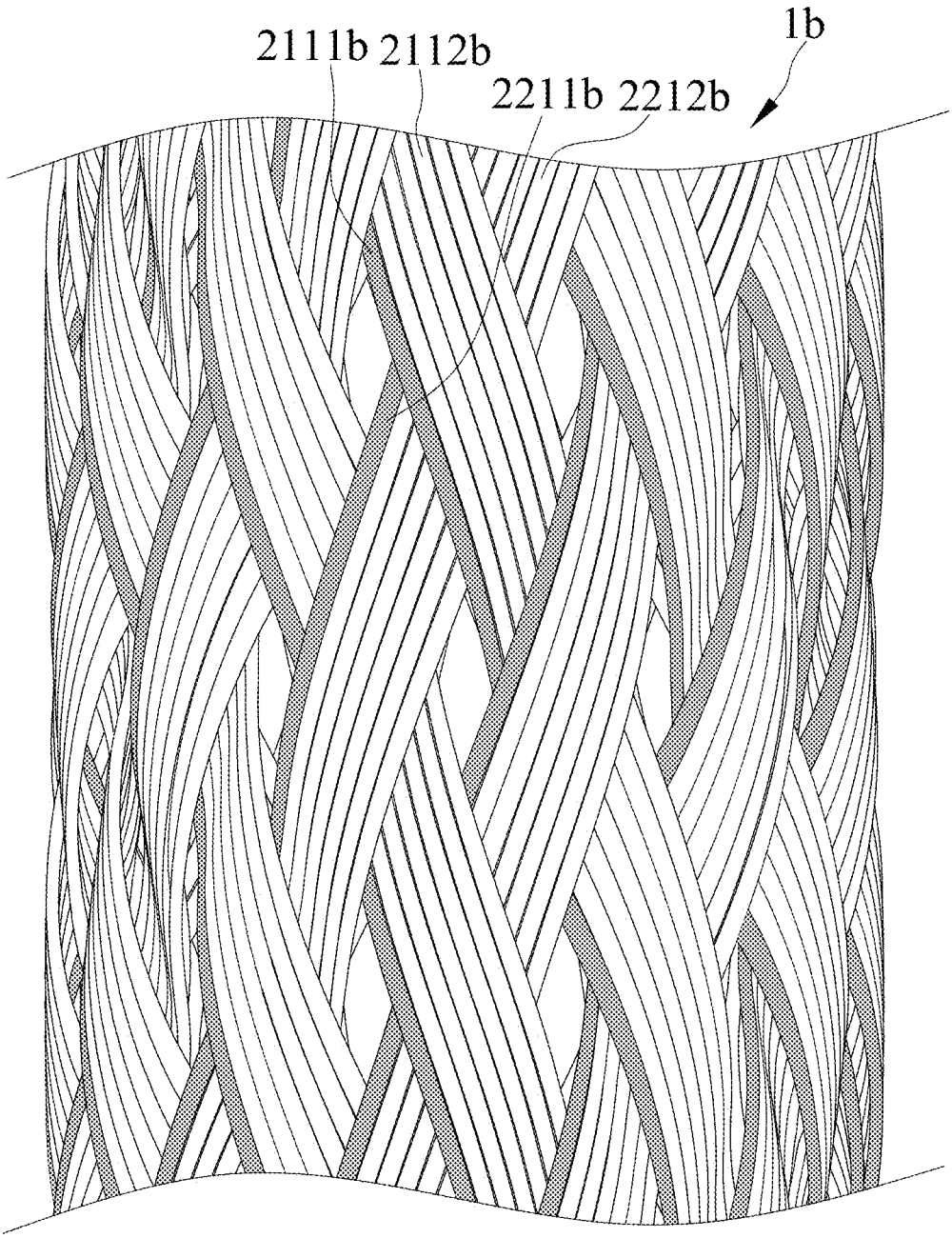
FIG. 6 is an enlarged partial perspective view of a flame-resistant wick of a third embodiment according to the present invention.

FIG. 6 show a flame-resistant wick 1*b* of a third embodiment according to the present invention, and the same numbers are used to correlate similar components of the first embodiment, but bearing a letter b. The at least one of the plurality of first core wires 2111*b* and the at least one of the plurality of second core wires 2211*b* are made of copper. The others of the plurality of first core wires 2112*b* and the others of the plurality of second core wires 2212*b* are made of non-copper materials such as stainless steel. Thus, the number of the plurality of first and second core wires 2111*b* and 2211*b* made of copper is not greater than the number of the plurality of first and second core wires 2112*b* and 2212*b* made of non-copper materials. Therefore, the at least one of the plurality of first and second core wires 2111*b* and 2211*b* made of copper improve the thermal conductivity of the flame-resistant wick 1*b* to facilitate heat transfer, so that the fuel is more easily vaporized, thereby improving combustion efficiency.

Figure 7:
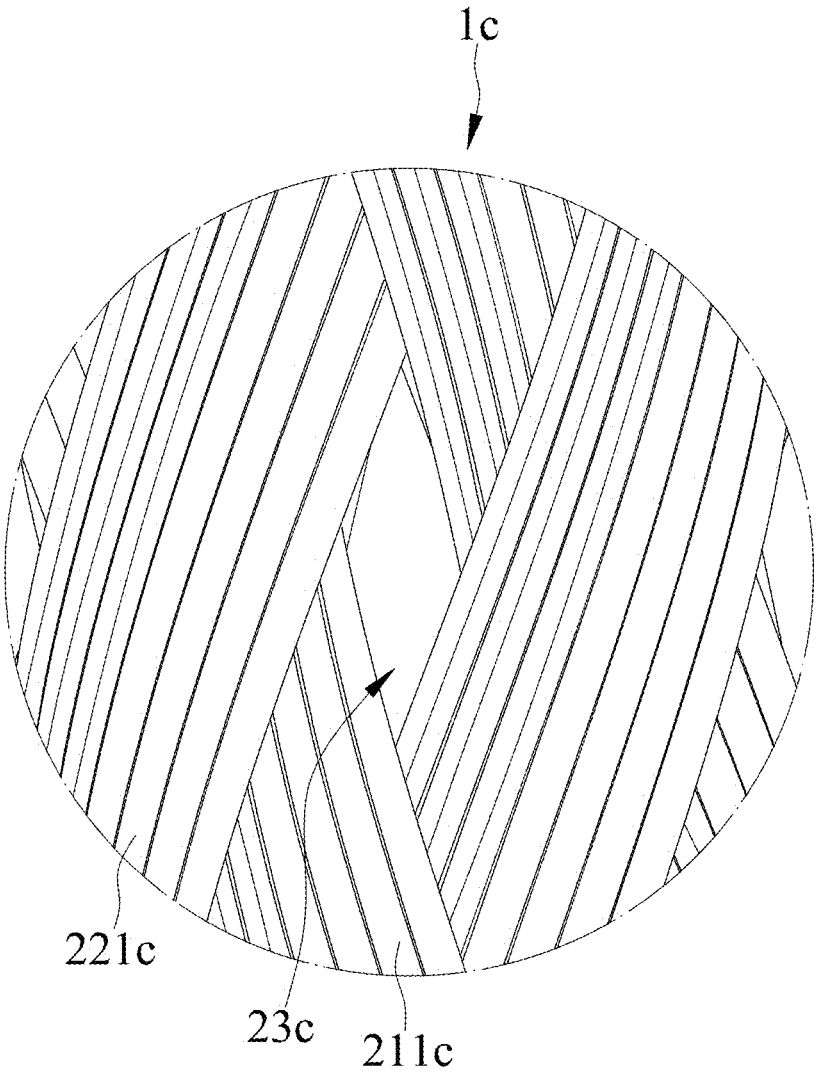
FIG. 7 is an enlarged partial perspective view of a flame-resistant wick of a fourth embodiment according to the present invention.

FIG. 7 show a flame-resistant wick 1*c* of a fourth embodiment according to the present invention, and the same numbers are used to correlate similar components of the first embodiment, but bearing a letter c. Each of the plurality of first and second core wires 211*c* and 221*c* has a different wire diameter to the others to change the size of the meshes 23*c* to increase the capillary action of the flame-resistant wick 1*c* to improve the combustion efficiency.

Figure 8:
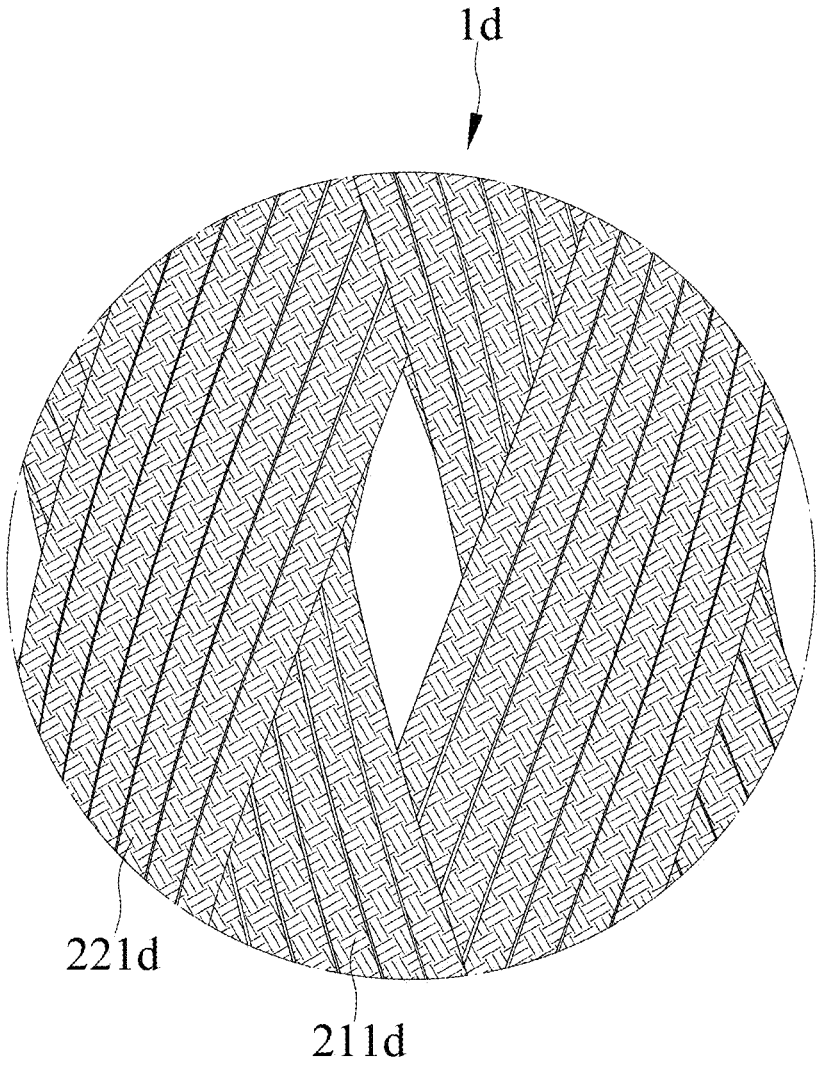
FIG. 8 is an enlarged partial perspective view of a flame-resistant wick of a fifth embodiment according to the present invention.

FIG. 8 show a flame-resistant wick 1*d* of a fifth embodiment according to the present invention, and the same numbers are used to correlate similar components of the first embodiment, but bearing a letter d. The plurality of first and second core wires 211*d* and 221*d* are made of carbon fiber material. The denier count of the carbon fiber material can be between 150 to 300 denier, thereby improving the structural strength and capillary action of the flame resistant wick 1*d* to improve the combustion efficiency.

Figure 9:
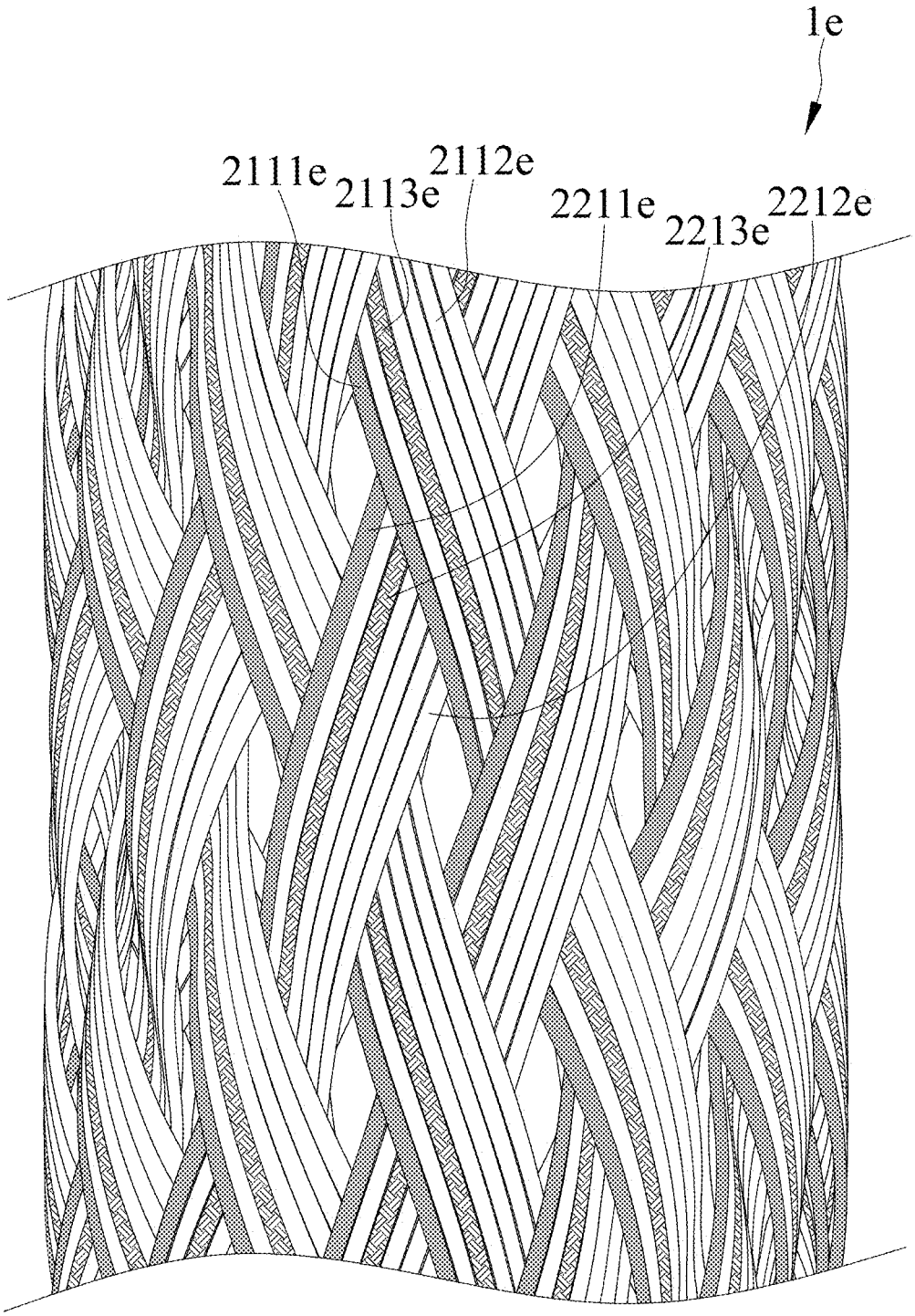
FIG. 9 is an enlarged partial perspective view of a flame-resistant wick of a sixth embodiment according to the present invention.

FIG. 9 show a flame-resistant wick 1*e* of a sixth embodiment according to the present invention, and the same numbers are used to correlate similar components of the first embodiment, but bearing a letter e. The at least one of the plurality of first core wires 2111*e* and the at least one of the plurality of second core wires 2211*e* are made of copper. The others of the plurality of first core wires 2112*e* and 2113*e*, and the others of the plurality of second core wires 2212*e* and 2213*e* are made of non-copper materials such as stainless steel and carbon fiber material. Further, at least one of the others of the plurality of first core wires 2112*e* and 2113*e*, and at least one of the others of the plurality of second core wires 2212*e* and 2213*e* are made of carbon fiber material. Thus, the number of the plurality of first and second core wires 2111*e* and 2211*e* made of copper is not greater than the number of the plurality of first and second core wires 2112*e*, 2113*e*, 2212*e*, and 2213*e* made of non-copper materials, but is equal to the number of the plurality of first and second core wires 2112*e*, 2113*e*, 2212*e*, and 2213*e* made of carbon fiber material.

The flame-resistant wicks 1; 1*a*; 1*b*; 1*c*; 1*d*; 1*e* according to the present invention include the following advantages:

1. The flame-resistant wicks 1; 1*a*; 1*b*; 1*c*; 1*d*; le are made of the material having a melting point of not less than 800° C., so that it cannot be carbonized or consumed, to fix its shape and height thereof to maintain the flame combustion scale.

2. The flame-resistant wicks 1; 1*a*; 1*b*; 1*c*; 1*d*; 1*e* include an end producing the flame thereon and heated by the flame to cause fuel drawn to the end thereof to be vaporized and combusted more completely due to a higher wick temperature.

3. The flame-resistant wicks 1; 1*a*; 1*b*; 1*c*; 1*d*; 1*e* do not loosen at its terminal end after cutting a predetermined length or trimming to be mounted on the fuel container S.

4. The flame-resistant wicks 1; 1*a*; 1*b*; 1*c*; 1*d*; 1*e* are made of metals or carbon fiber material reducing manufacturing costs to provide a popular price.

5. The flame-resistant wicks 1; 1*a*; 1*b*; 1*c*; 1*d*; 1*e* are flexible and are capable of being bent into a U shape to be employed in many ways.

Although specific embodiments have been illustrated and described, numerous modifications and variations are still possible without departing from the scope of the invention. The scope of the invention is limited by the accompanying claims.

What is claimed is:

1. A flame-resistant wick comprising:

a hollow chamber; and at least one capillary structure surrounding the hollow chamber and interlaced by a plurality of wire strands into a tubular shape, with each of the plurality of wire strands consisting of a plurality of core wires made of a material having a melting point of not less than 800° C., wherein each of the plurality of core wires has a different wire diameter to the others.

2. The flame-resistant wick as claimed in claim 1, wherein the at least one capillary structure is flexible.

3. The flame-resistant wick as claimed in claim 2, wherein the at least one capillary structure is capable of being bent into a U shape to form an igniting end and two drawing ends located opposite to the igniting end.

4. The flame-resistant wick as claimed in claim 1, wherein the plurality of wire strands includes a plurality of first wire strands and a plurality of second wire strands interlaced with one another, and wherein each of the plurality of first wire strands interlaces with at least one of the plurality of second wire strands to form an acute angle.

5. The flame-resistant wick as claimed in claim 4, wherein the plurality of first wire strands and the plurality of second wire strands interlace with one another to form a plurality of meshes, and wherein each of the plurality of meshes has the acute angle.

6. The flame-resistant wick as claimed in claim 1, wherein the at least one capillary structure includes two capillary structures, and wherein the two capillary structures are mounted around one another and extend along a central axis of the hollow chamber.

7. The flame-resistant wick as claimed in claim 1, wherein at least one of the plurality of core wires is made of metals whose melting point of not less than 800° C. or carbon fiber material.

8. The flame-resistant wick as claimed in claim 7, wherein the metals include copper or stainless steel.

9. The flame-resistant wick as claimed in claim 8, wherein the at least one of the plurality of core wires is made of copper, and wherein the others of the plurality of core wires are made of non-copper materials.

10. The flame-resistant wick as claimed in claim 9, wherein at least one of the others of the plurality of core wires is made of carbon fiber material.

11. The flame-resistant wick as claimed in claim 9, wherein the number of the plurality of core wires made of copper is not greater than the number of the plurality of core wires made of non-copper materials in each of the plurality of wire strands.

* * * * *